US006861959B1

(12) United States Patent
Torres Sabate et al.

(10) Patent No.: US 6,861,959 B1
(45) Date of Patent: Mar. 1, 2005

(54) HELP AND/OR RISK SIGNALING MEANS FOR THE TRAFFIC OF VEHICLES AND PEDESTRIANS USING A SHORT RANGE INFRARED OR ELECTROMAGNETIC SIGNALING SYSTEM

(75) Inventors: Armengol Torres Sabate, Barcelona (ES); Miguel Angel Argnieri, Barcelona (ES); Jose Maria Minguella Llobet, Aragon 383, 7ª Planta, Barcelona (ES); Ruben Horacio Gaggioli De Mauro, Aragon 383, 7ª Planta, Barcelona (ES)

(73) Assignees: Jose Maria Minguella Llobet, Barcelona (ES); Ruben Horacio Gaggioli de Mauro, Barcelona (ES)

( * ) Notice: Subject to any disclaimer, the term of this patent is extended or adjusted under 35 U.S.C. 154(b) by 0 days.

(21) Appl. No.: 10/129,027

(22) PCT Filed: Oct. 27, 1999

(86) PCT No.: PCT/ES99/00346

§ 371 (c)(1),
(2), (4) Date: Aug. 6, 2002

(87) PCT Pub. No.: WO01/31609

PCT Pub. Date: May 3, 2001

(51) Int. Cl.[7] ..... G08G 1/095

(52) U.S. Cl. ..... 340/944; 340/901; 340/905; 340/988; 340/989; 340/991

(58) Field of Search ..... 340/944, 901, 340/905, 988, 989, 991; 701/209, 213

(56) References Cited

U.S. PATENT DOCUMENTS

| | | | | | |
|---|---|---|---|---|---|
| 3,899,671 | A | * | 8/1975 | Stover | 455/524 |
| 5,164,904 | A | * | 11/1992 | Sumner | 701/117 |
| 5,214,793 | A | * | 5/1993 | Conway et al. | 455/500 |
| 5,805,082 | A | * | 9/1998 | Hassett | 340/928 |

FOREIGN PATENT DOCUMENTS

| | | |
|---|---|---|
| DE | 43 40 811 | 6/1995 |
| FR | 2 544 897 | 10/1984 |
| FR | 2 670 018 | 6/1992 |
| FR | 2 699 946 | 7/1994 |
| FR | 2 752 635 | 2/1998 |
| GB | 2 265 041 | 9/1993 |
| GB | 2 289 564 | 11/1995 |

* cited by examiner

*Primary Examiner*—Hung Nguyen
(74) *Attorney, Agent, or Firm*—Collard & Roe, P.C.

(57) ABSTRACT

The present invention incorporates fixed radio beacons (TX-F), mobile and portable radio beacons (TX-M), together with vehicle receiver units (RX-M) and/or receiver units (RX-P) carried by pedestrians for all types of warning and assistance messages, or both or either with mobile transceivers (TX/RX-M) for motor cars and other transceivers (TX/RX-P) for pedestrians, the latter for transmitting and receiving similar warning and assistance messages, all being controlled by an operations center (CO) and which has a services network, with elements which are fixed, mobile or portable (SM).

15 Claims, 2 Drawing Sheets

Fig. 1
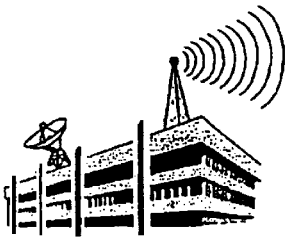
Fig. 1a
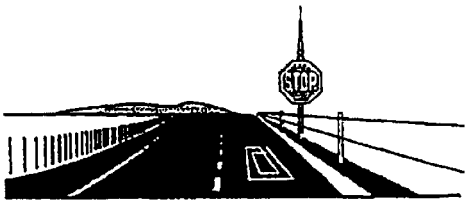
Fig. 1b
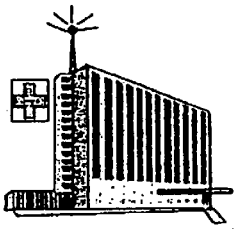
Fig. 1c
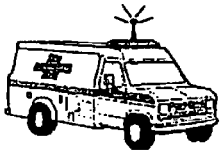
Fig. 1d
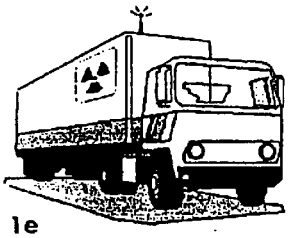
Fig. 1e
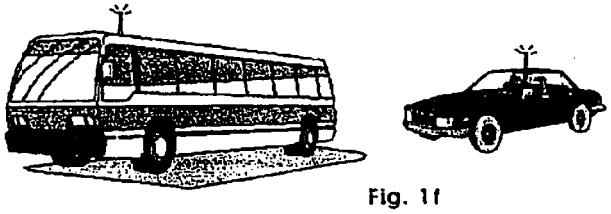
Fig. 1f
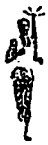
Fig. 1g
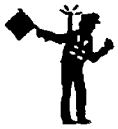
Fig. 1h
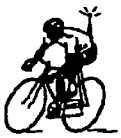
Fig. 1i
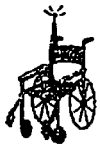
Fig. 1j Fig. 2
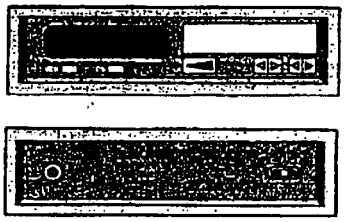
Fig. 2a
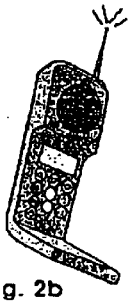
Fig. 2b
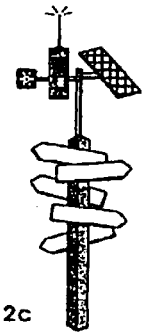
Fig. 2c
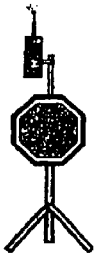
Fig. 2d
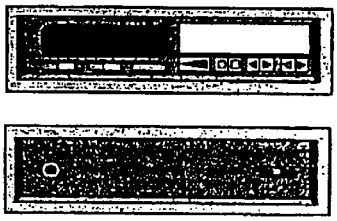
Fig. 2e
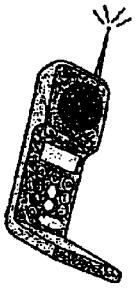
Fig. 2i
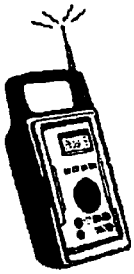
Fig. 2g
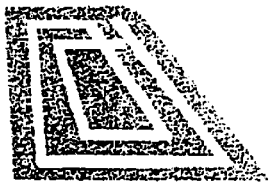
Fig. 2h

HELP AND/OR RISK SIGNALING MEANS FOR THE TRAFFIC OF VEHICLES AND PEDESTRIANS USING A SHORT RANGE INFRARED OR ELECTROMAGNETIC SIGNALING SYSTEM

CROSS REFERENCE TO RELATED APPLICATIONS

Applicants also claim priority under 35 U.S.C. §120 of PCT/ES99/00346 filed Oct. 27, 1999. The international application under PCT article 21(2) was not published in English.

OBJECT OF THE INVENTION

The invention proposed herein comprises means for hazard and/or assistance signalling for vehicular traffic and/or pedestrians by short range infrared or electromagnetic signalling. Said means is of the type which contributes to road safety and to assisting drivers and pedestrians in built-up areas and on the open road and is particularly characterised in that it resolves in a manner which is straightforward, fast and economical, among others, not only situations which are highly problematic, like the so-called black spots on roads but also others of a transitory or occasional nature, unavoidable even with major infrastructure works, and also for routine situations in which warning is given of exceeding the recommended or permitted speed limit, though it also includes statistical applications for traffic, as well as for the drafting of accident reports when employed in its black box mode.

Said means is based on the joint use of radio beacons or tags installed at those key locations, together with receiver units installed in vehicles or carried by pedestrians, giving them sufficient advance notice of the proximity of problematic situations, of areas of danger or hazardous elements, as well as of locations of assistance to the traveller (e.g. the nearness of public emergency services or first aid posts, independent of working hours or holidays) or of natural phenomena (like reduced visibility due to fog or severe rainstorms) and even of natural or unnatural disasters and the impact of all of the foregoing on the maximum permitted or recommended speed. Optionally, the possibility remains open of incorporating global positioning by satellite (GPS) technology or mobile telephony in the radio beacons for specific applications.

BACKGROUND TO THE INVENTION

Together with the usual networks of urban traffic lights or the typical road signs, other systems are becoming known and finding complementary or supportive utility in assisting the general traveller, said systems being global positioning by satellite communications, such as GPS, and also telephone systems, such as Inmarsat or Iridium, etc., or others for mobile telephony, such as GSM, AMPS, etc., together with those for paging, such as Pager.

There are also broadcast radio systems, such as RDS (Radio Data System) or DRB (Digital Radio Broadcasting). Others are based on computer operating systems arising from Microsoft Windows, such as AutoPC.

Insofar as the technologies employed for vehicle identification are concerned, widespread deployment already exists of AVI (Automatic Vehicle Identification) and RFID (Radio-frequency Identification), which mainly find use in motorway electronic toll collection when the vehicles pass a determined point like, for example, the payment booths.

These advances in technology have seen their accuracy and reliability greatly enhanced and their cost of implementation or deployment reduced considerably, for which reason new uses are becoming feasible. This technology is used in the present invention as part of its principal components, which have to be suitably adapted to adjust to its objectives.

Finally mention has to be made of the existence of police radar detecting devices, which have had their functions extended to become Safety Warning System (SWS) devices, similar to those described in the present invention.

Based on the previously existing device for radar detection, these incorporate detectors of traffic hazard signals. In this case the transmitters broadcast radio waves on the same frequency-as the police radar, so that the receivers only incorporate a memory to translate the code transmitted into one of 60 possible warning signals.

The transmitters can be mobile, being incorporated in emergency vehicles, such as police cars, fire trucks, ambulances, etc., or in fixed locations at traffic danger points, such as intersections, bridges, etc. But in no case are the transmitters designed to form a radio beacon network, in which the information they transmit cannot be modified remotely or incorporate geographical or topographical data, information for tourists, first aid, services, identification and black box facilities, etc., being capable only of serving as a warning mechanism.

The technical: characteristics of these radio transmitters are as follows:

Power: 50 mW, rated value.

Working frequency: 24.1 GHz (the same frequency band as the police radar in North America).

Transmitted power density: 1 mW/cm2 on the side incorporating the antenna (comparable with the density in police radar equipment).

Voltage: between +10 and +16 VDC (connectable to the vehicle emergency light circuit).

Transmission pattern: Bidirectional, beam of 23° in horizontal plane and aligned along the longitudinal axis of the vehicle.

Message transmission: any one of the 64 pre-established for SWS. The transmitter selects automatically between two types of message: one if the transmitter is located in a moving vehicle (e.g. alarm of emergency vehicle in motion), and another if it is stopped (e.g. accident alarm).

Electronic characteristics: digital signal processing, high density, surface-mount technology, non-erasable memory.

Admissible temperature range: operational, between −30° C. and 65° C.; off, between −40° C. and +85° C.

Impact and vibration: withstands an impact of 10 G in half-sinusoidal wave lasting for 11 ms, and vibration of 1.4 G in sinusoid at between 10 and 60 Hz, in all cases parallel to the vertical axis, with no resulting permanent damage.

Weather resistance: Designed for mounting externally on vehicles or for installation at fixed outdoor sites.

DESCRIPTION OF THE INVENTION

The means of the invention consists in the joint use of the following elements:

Transmitting radio beacons (TX), serving to indicated danger areas or elements where risk exists and/or assistance is available, by means of short range infrared or radio signals, of different types or codes.

Radio beacon signal receivers (RX), picking up transmissions and producing different types of alarm or messages for the users.

Operations Centre (CO), serving for the maintenance, management and control of all elements in the radio beacon service network in question.

The function of the TX is fourfold:

1.—Warning, which indicates the location of an area of risk for drivers or pedestrians, identifying also who is sending the signal in question (police, fixed radio beacon, truck, individual, etc.) and the condition he is in (priority passing request, fog, dangerous load, SOS, etc.). Among its main functions is that of converting the traffic signals into "talking signals" which would give spoken indication of its significance a few meters before or at the actual warning point. As an extension to this function, it includes the possibility of warning the driver if he is exceeding the maximum permitted or recommended speed limit for a given section of road and, what is a greater innovation, in accordance with the current local weather conditions.

2.—Assistance, which indicates the location of a post providing assistance or help for drivers or pedestrians, identifying in turn who is transmitting the signal (Ambulance, Chemist's Shop, etc.) and what state it is in (in service, guard duty, etc.).

3.—Position, which is a topographical indicator, informing the driver of the location of the radio beacon on the roadmap with complementary information like the town name, road number, distance, height above sea level, and other useful data, such as number of restaurants, chemist shops, museums, etc.

4.—Identification, which permits identification of the vehicle and/or user of the receiver (RX) for both assistance and security purposes, facilitating, in the last resort, a black box function.

The emplacement of the TX can be done in a fixed or moveable manner, to satisfy the legislation in force, while the RX shall be employed in a mobile environment (motor cars, trucks) or in portable fashion (pedestrians, cyclists). It is also anticipated there shall be mixed Transmitter/Receiver units (TX/RX or transceivers) for moving elements which in turn represent a hazard, such as trucks carrying dangerous loads; for special vehicles such as ambulances; for pedestrians in danger or for drivers who wish to have the SOS function in their terminal.

The messages originated by the TX are offered to the user in a precise and as appropriate manner, through the receiver unit (RX) installed in the vehicle or carried by the pedestrian. When approaching a TX signalling point, the RX unit shall alert the user or driver by warning light or audibly (both by beeping and spoken message), showing also on a display unit a brief and precise text giving details of the message.

The user shall always hear the messages in his own language independently of the country in which he is travelling, since the signals transmitted consist of codes to be processed in his receiver and not open voice, except for exceptional and extraordinary warning instances. After having taken the necessary precautions, and when moving away from the danger area or hazard (for example, reducing speed if this had been too fast), the receiver unit falls silent and remains on standby ready to act again with no requirement for manual intervention on the part of the driver or user.

The users who carry a receiver with them can likewise be advised of those different danger zones or assistance points when traversing areas with radio beacon coverage.

For the case of warning messages, these are produced sufficiently beforehand to permit the user to take avoiding action free from surprise, like putting him on alert, suggesting he reduce speed or bring the vehicle to a complete stop, depending on the case, etc.

For Assistance situations, the user shall be able to choose the type of help he requires while driving or in motion and, at a certain distance from the point he requires, the RX shall advise him of its proximity in a more precise manner. The users of TX/RX versions shall also be able to transmit a help signal (SOS) to be picked up by the pertinent support service or by other drivers or passers-by using an RX. The SOS signal can be activated voluntarily or automatically, e.g. actuated by the ballooning of the vehicle airbag.

The audible signals are fundamental in this invention as they make use of the sensory organ least saturated while driving for facilitating the reception and interpretation of the message. Solely visual messages, which constitute the greater part of traditional roadway signalling, encounter their greatest limitation in that they require the driver to shift momentarily his attention away from the road and also their interpretation, and even detection, can be seriously impeded by conditions of poor visibility or a state of distraction.

The system proposed removes the factor of chance from reading and interpreting signs, since the reading and decoding of the signal is reliably translated into an unmistakable audible message.

BRIEF DESCRIPTION OF THE FIGURES

FIG. 1 shows, in schematic form, the operations centre, the fixed and mobile radio beacons, and also others of the portable type.

FIG. 2 shows in greater detail the receivers, radio beacons and transceivers, as well as elements in the service network connected with the operations centre.

DESCRIPTION OF THE INVENTION

1.—Description of the Warning Functions.

1.1.—"Permanent Fixed Warnings" (AFP):

Advise of the proximity of an area of permanent danger, like a black spot on a road, and incorporates a TX-F element permanently installed on a post or on a wall, or else buried beneath the pavement (FIG. 1*b*), for example an independent tag fed by solar power or some other means.

This warning can refer to a dangerous bend, a road intersection, an unprotected level crossing, a narrow bridge, an animal crossing point, vehicle entry or exit point, motorway slip road, message of approaching road exit point, recommended diversions, and others.

1.2.—"Temporary Fixed Warnings" (AFT):

They warn of a nearby temporary danger area at a fixed location, such as temporary black spots. They have an independent warning capability of occurrences, such as a fog detector, etc., or by means of data received from an operations centre, or from third parties equipped with mobile transmitters, like the police, etc. (FIG. 1*h*), and the warnings are only produced while the risk is present, otherwise they remain silent.

It incorporates a TX-F element permanently installed on a post or on a wall, or else buried beneath the pavement, or even on portable stands where the beacons serve to mark accidents, road works, etc.; the beacons or tags are independent and fed by solar power or some other means.

Serving as examples of this type of warning are fog, ice, snow, torrential rain, low visibility, gales, etc., as well as road accidents, or recommendations concerning night driving or fatigue (occasional reminders for nocturnal travellers or dates on which there is greatest probability of encountering drunk drivers, etc.), as well as nearby traffic congestion, messages of recommended diversions, obstructions, repair works, road checks, etc. Another of the most significant applications is signalling speeding, travelling faster than that permitted or recommended on a given section of road, which can be modified according to the local weather conditions existing at the time the vehicle passes.

1.3.—"Mobile Warnings" (AM):

Warn of the closeness and situation of a moving hazard, such as a priority passage request, etc., having independent capability of warning of occurrences.

It incorporates a TX/RX-M element installed in moving vehicles, or TX/RX-P, in the case of pedestrians or cyclists; examples of the types of warning being the transporting of dangerous loads (trucks carrying inflammable or corrosive materials, etc.); requests to pass broadcast by police patrol cars, traffic police, ambulances, fire brigades, civil protection, etc. (FIG. 1*d*); as well as the proximity of cyclists, joggers, horse riders, or motor cyclists. (FIGS. 1*i*, 1*g*).

The warning signals have two levels of risk or importance—high priority, for example, fog, snow, dangerous bend, ambulance exit, SOS, etc., or secondary priority, like traffic congestion, dangerous loads, cyclists, etc., which shall permit the users to avoid being molested by continuous warning messages at certain times. The high priority messages shall only be suppressed if the receiver is completely disconnected.

2.—Description of the Assistance Functions.

2.1.—Autonomous identification of the vicinity of different services and/or assistance or emergency posts. It incorporates a TX-F element permanently installed on a post or on a wall, or else buried beneath the pavement, and specific TX/RX-M elements.

2.2.—It transmits an SOS signal in the case of a user finding himself at risk or in an accident situation, by means of a TX/RX-P or TX/RX-M element.

These "X" type warnings can be an SOS signal from a driver or pedestrian requesting assistance. (FIGS. 1*f*, 1*g*, 1*j*); presence of patrol cars or service points: police, ambulance, fire brigade, civil protection (FIG. 1*d*); duty chemists, hospital, red cross, medical centre, etc. (FIG. 1*c*); location of emergency or fire-fighting facilities on the main road; repair service, tow trucks, petrol stations, etc.; information point for tourists; shops open 24 hours (grocers, department stores, etc.); services available 24 hours (locksmiths, electricians, etc.).

The Assistance signals can also be classified into two levels of importance: high priority, like request for an ambulance, SOS, duty chemist, etc.), and secondary priority, like all-day services or others, under similar operational conditions as in the case of warnings.

3.—Description of Positioning Functions.

In like fashion to the conventional roadside milestones, this function permits the users passing close by to obtain local geographical and/or topographical information of help to the traveller like, for example, his position on the roadmap. They can also obtain complementary information related with local tourism, like the name of the town, height above sea level, etc.

Apart from all those mentioned here, are those concerning persons or vehicles that have suffered an accident (for example, haven fallen into a gully); abduction (such as persons forced into motor car boots, whether stopped or moving) and, in general, in all those extraordinary circumstances or events as may be applicable, such as desert rallies, being lost in mountainous areas or others in which receivers can be mounted in highly mobile independent means, for example helicopters or the like.

4.—Description of the Identification Functions.

This concerns a function which, enabled at the will of the user, transmits a signal which identifies him or his vehicle together with his location. This signal or code can be compared with information available in a user database in the hands of the security or assistance services in order to identify him unequivocally.

In addition it offers a black box facility, a special function which consists of an electronic memory protected against all kinds of accident and capable of storing all the signals received and/or transmitted by radio beacons, in at least the last 24 hours or the last kilometers travelled, in a continuous and uninterrupted manner.

It shall also record, among other items, the identity of the radio beacons from which it has received any type of signal together with their type, in addition to all own transmitted signals and the status of the functions of the device (off, with or without audible signal, etc.). All records are recorded with the precise time and date facilitated by an internal clock.

Its purpose is to keep a record which can serve the examiners in the analysis of a possible traffic accident or for statistical purposes.

Access to this information shall only be available to authorised technicians and the information stored shall be impossible to alter. In this facility, regarding the information obtained, all guarantees relating to privacy and personal matters shall be respected.

5.—Specific Functions Concerning Pedestrians.

Identification of the proximity of different items of interest for normal pedestrians and those with special needs (the blind, disabled, tourists, children, etc.), by means of RX-P or TX/RX-P.

5.1.—Warning Messages (AEP):

These are notices intended to warn pedestrians of hazards on their routes: traffic lights, zebra crossings, street and avenue intersections, docks, and also their closeness for the pedestrian with special needs (blind, disabled, etc.).

5.2.—Assistance Messages (XEP):

Notices intended to indicate the closeness and location of sites and elements offering help for the pedestrian on his journey, such as the nearness of facilities for the blind; bus stops and taxi stands, underground stations, etc.; telephone booths, public toilets, etc.; SOS signal for pedestrian requesting help.

These signals are likewise classified into two levels of importance: high priority (traffic lights, intersections, docks, etc.) and secondary priority (bus stops and taxi stands, etc.).

6.—Detailed Description and Operation of the Radio Beacon or Tag Elements.

6.1.—Vehicle Receiver (RX-M)

Radio receiver unit (FIG. 2*a*), with receiver terminal only which, installed in a motor vehicle, receives the signals broadcast by the radio beacon transmitters and communicates these to the driver by means of audible signals, visual display or spoken messages. Its dimensions are similar to those of a car radio unit and the users are individual or professional drivers of motor vehicles (FIGS. 1*d*, 1*e*, 1*f*). Its main parts are a loudspeaker, the repeat-last-message button, the warning message filtering buttons, an alphanumeric display, the help message filtering buttons, the programmable function buttons, the antenna socket and the power supply socket.

Its main functions are: to receive all types of warning and assistance messages (AFP, AFT, AEP, XEP, X), to filter the different message classes, to repeat the last message received, to program user functions and special functions, the last to be done only by an authorised technician.

6.2.—Pedestrian Receiver (RX-P)

This radio receiver unit (FIG. 2*b*), with receiver terminal function only which, carried by pedestrians or persons driving horse-drawn carriages, receives the warning signals broadcast by the radio beacon transmitters and communicates these to the driver by means of audible signals, visual display or spoken messages. It is similar to that previously described, but has dimensions and functions appropriate to the pedestrian environment, having external features similar to those of a mobile telephone, its users being normal pedestrians or those with special needs for mobility (wheelchair, the blind, cyclists, joggers, horse riders, etc.). (FIGS. 1*g*, 1*i*, 1*j*).

It comprises the following main parts: a loudspeaker, antenna, programmable function buttons, alphanumeric display, warning message filtering buttons, help message filtering buttons and repeat-last-message button.

Its main functions are: to receive all types of warning and help messages (AFP, AFT, AM, AEP, XEP, X), to filter the different message classes, to repeat the last message received, to program user functions and special functions, the last to be done only by an authorised technician.

6.3.—Fixed Transmitter (TX-F) or Fixed Radio Beacon.

This consists of a radio transmitter working only as a transmitting unit for a fixed unit, of the type mounted on a roadside post or against a wall (FIG. 2*c*), or else embedded in the pavement (FIG. 2*h*) and which, installed in a permanent fashion near black spots or hazards and/or the help posts, continuously transmits short range radio beacon signals, to be picked up by radio beacon receivers, the users being all those shown as such in FIG. 1.

Its main components are the transmitter, the antenna, the power supply by solar panel or other autonomous means, the supporting elements, the post or support and the weather condition sensor, its main functions being to transmit all types of warning and help messages (AFP, AFT, AEP, XEP, X), permanent, occasional or programmed broadcasting, producing warnings depending on weather conditions (fog, snow, rain, wind, etc.).

The "embedded in the pavement" version is to be preferred for its low cost and resistance to weather conditions for the main function of serving in a manner equivalent to the traffic signs, and for detecting and warning against speeding (FIG. 2*h*).

6.4.—Mobile or Portable Transmitter or Radio Beacon (TX-M)

This radio transmitter (FIG. 2*d*), similar to that described previously, is a transmitter only for a portable or mobile unit, installed on a temporary support, for the purpose of temporarily signalling hazards or assistance posts, being used by the police, ambulance service, fire brigades, civil protection, etc., and its main elements are: the transmitter, the autonomous battery power supply, the fixing elements and the traffic sign or the portable stand, its main functions being to broadcast warning and assistance messages (AFT, AEP, XEP, X) and occasional or programmed transmissions.

6.5.—Mobile Transceiver (TX/RX-M)

This mobile radio transceiver (FIG. 2*e*) incorporates the above two items, transmitter and receiver, and is installed in a motor vehicle which receives the signals broadcast by other radio beacon transmitters and communicates these to the driver by means of audible signals, visual display and spoken messages. It also transmits automatically warning and/or assistance messages (SOS, priority passing requirement for ambulance service, dangerous materials transport, etc., and its users are either drivers of private vehicles performing SOS functions, or professional drivers of trucks, taxis, public service vehicles, police cars, fire service and ambulances), pilots of helicopters for security, assistance or maintenance.

Its main parts are the loudspeaker, the repeat-last-message button, the warning message filtering buttons, the alphanumeric display, the help message filtering buttons, the programmable function buttons, the SOS button, the antenna socket, the power supply socket, the airbag mechanism connection and the specific warning broadcast buttons (AM).

Its main functions are: to receive all types of warning and assistance messages (AFP, AFT, AM, AEP, XEP, X), to filter the different message classes, to repeat the last message received, to broadcast SOS signals either manually or independently as well as AM and X warnings and, finally, to program user functions and special functions, the last to be done only by an authorised technician.

6.6—Portable Transceiver (TX/RX-P).

This consists of a portable transceiver (FIG. 2*f*) which receives the signals broadcast by radio beacon transmitters and communicates these to the user by means of audible signals, visual display and spoken messages. At the same time it can also transmit warning and/or assistance messages to be picked up by other nearby users. It is of a size similar to that of a mobile telephone and it is for use both by normal pedestrians and those with special needs for movement and drivers of small vehicles or persons at risk, such as wheelchair users, the blind, cyclists, joggers, horse riders, etc. (FIGS. 1*g*, 1*i*, 1*j*).

Its main parts are the loudspeaker, the antenna, the programmable function buttons, the alphanumeric display, the warning message filtering buttons, the help message filtering buttons, the repeat-last-message button and the SOS button.

Its main functions are: to receive all types of warning and assistance messages (AFP, AFT, AM, AEP, XEP, X), to filter the different message classes, to repeat the last message received, to broadcast SOS signals either manually or independently, as well as AEP warnings and, to program user functions and special functions, the last to be done only by an authorised technician.

6.7.—Operations Centre

This is the operations base (CO) (FIG. 1*a*), from where coordination is provide for operation, management, administration, maintenance and control of all the elements forming the radio beacon services network, serving to ensure the correct functioning of the services network for maintenance, reprogramming, specific signal transmission to determined remote radio beacons, etc., its users being all in possession of radio beacon elements (individuals, professionals, officials).

Their main operating parts are the antennas, the management and operational control of the network and of the maintenance, its main functions being operational and technical management, broadcasting and receiving all types of warning and assistance messages (AFP, AFT, AM, AEP, XEP, X), local and remote programming of radio beacons, programming of user functions and special functions, the latter only being done by authorised technicians, apart from other more conventional functions like the administration of the radio beacon services network by radio means, Internet or other telecommunications networks.

6.8.—Services Network

This is composed of both the fixed elements installed on the roadway and the fleet of mobile elements attributed to it for safekeeping and maintenance. It can include elements belonging indistinctly to private citizens or the public sector, such as transmitters housed in chemists' shops and/or medical centres, which wish to enjoy the benefit of coordination and maintenance provided by the Operations Centre, its users being all owners or users of radio beacon elements, be they private citizens, professionals or officials.

Its main parts are formed by the fixed, mobile, portable and personal radio beacons mentioned, the service network and the elements for management, control and maintenance, and by public or private telecommunications networks.

6.9.—Maintenance and Control Elements (FIG. 2*g*)

These constitute the assembly of fixed, mobile and portable devices (SM), required for the specific maintenance of the services network and the radio beacon elements of private individuals, professionals or officials, for exclusive use by the technical staff of the Operations Centre (CO) and by technicians authorised by it to provide technical support services.

Determined types of function may only be programmed by another class of official technicians, such as ambulance service functions, etc., for portable use, from a mobile unit, or from the maintenance helicopter, and access to the black box data.

Its main parts are the antenna, the alphanumeric display, the function programming buttons and the function supervisory buttons.

Its main functions are: local and remote programming of radio beacons, programming user functions and special functions by authorised technicians, supervision of the status of the radio beacons (receivers, transmitters and transceivers), transmitting and receiving all types of warning and assistance messages (AFP, AFT, AM, AEP, XEP, X), and the down-loading of the information held in the black box.

7.—Technical Characteristics

The technology employed is based on the use of the aforementioned AVI and RFID systems, adapted to the requirements of the present invention. The AVI systems base their operation on the combined use of a fixed radio transceiver unit, positioned with its antenna at the motorway toll collection posts, and the use of printed circuit assemblies termed "tags" which are mounted on the vehicles of the users. Whenever the user with a tag passes the antenna, a communication is set up between the two (established following industry standards/protocols) which serves to identify the user and debit the pertinent fee for the use of the motorway, etc.

Within the tag standards for AVI systems, there exist three main categories:

- Type I (passive tags): these contain permanent information, i.e. read only.
- Type II (intelligent or smart tags): these are active circuits containing partly fixed or read-only information and partly able to be reprogrammed by the external control element or reader.
- Type III (smart tags with RF transponder): these also are active circuits like Type II but having more advanced functions and larger memory capacity).

These three classes are intended for use with this invention, with modifications to permit them to be adapted for the different functions foreseen and, in particular, with respect to the required range (between transmitter and receiver) to achieve the appropriate forewarning in time and position.

The main novelty that this invention introduces in the use of AVI technology is that it inverts the physical emplacement. The elements employed normally in AVI systems as receivers, become transmitters, and, instead of being installed at fixed sites, they are mounted in the vehicles forming an integral part of the equipment carried by the user.

For their part, the so-called tags, are used here in a fixed manner as transmitters, installed either at the roadside or else attached to or embedded in the roadway, becoming thereby virtual intelligent and programmable traffic signs.

This invention presents notable advances which distinguish it from the SWS and like systems in that:

- The signalling is achieved in this case by straightforward, minute elements which can be installed unobtrusively, with no impact on the landscape, for example, below the asphalt of the road where, in addition, they are less likely to suffer theft or vandalism. It also permits the simultaneous installation of various different or identical message transmitters (to achieve greater reliability through redundancy) at any given point.
- The communication of occurrences is immediate, in contrast with radio data systems (RDS), digital broadcasting systems (DBS), pagers, GSM telephony, SWS, etc.
- High directivity and effectiveness; the main warning functions are emitted by elements located on the roadway, and their signals only reach those vehicles passing over them and no others like, for example, those travelling in the opposite direction. In addition, their limited range and power prevent tripping of false alarms in vehicular or pedestrian equipment located outside the context of the signalling point.
- The extremely low cost of the transmitters allow massive deployment.
- The improved tolerance to weather conditions due to their robustness, absence of moving parts and hermetic seal enhance the durability of the product.
- Negligible or zero cost of maintenance during its useful lifetime is possible thanks to the fact that it can be fed by a long-life battery or solar power, making it conceptually comparable with standard traffic signs, while the SWS is more similar to the traffic lights concept, where permanent maintenance is required and power consumption is high.
- The black box function facilitates statistical functions and accident reporting.
- The receiver bearer identification function permits specific or security applications.
- The function of warning of exceeding the permitted or recommended speed limit can be adjusted automatically depending on weather conditions, requiring only the installation of two tags in the asphalt at a suitable distance from each other.
- The signalling of a complete range of advisory functions useful to the traveller, like warnings, help or complementary information, for example related to tourism, for the handicapped, etc.
- The possibility of configuring or reprogramming the equipment remotely, thanks to a device for local use or through connection to a data network.

Alternatively, and for special purposes foreseen in this invention, it shall also be possible to make use of other communications technologies between transmitter and receiver based on infrared beams (IRC), also employing industry standards and protocols.

Main technical characteristics of the transmitter elements based on the tag technology of the AVI system:

- Power: the limitation for AVI civilian uses, which do not require an official user licence.
- Operational frequencies: those authorised for AVI applications—900 to 928 MHz; 2.45 GHz and 5.8 GHz.

Voltage: own supply from long-life batteries, up to ten years, or by solar panels, or supply-free (passive tags).

Message transmission: all those defined in this invention.

Range: depending on the version, up to 10 m (for location of posts or under the road surface), and up to 100 m (for mobile, portable or other uses).

Electronic features: adapted AVI technology, surface acoustic wave (SAW) technology, memories—EPROM, EEPROM, ROM and/or RAM. Memory capacity—between 1024 bits and 16 Megabits or higher, depending on tag technology employed.

Permissible temperature range: standard operation between B401C and 851C. Storage—between B551C and 1251C, though wider ranges can be obtained for cases where extreme environmental conditions prevail.

Resistance to weather conditions: designed for mounting in outdoor housings, fixed or temporary, capable of withstanding all kinds of climatic condition. Designs also available for portable assembly (personal) or mobile (vehicular).

Main technical characteristics of the receiver elements:

Power: the limitation for AVI civilian uses, which do not require an official user licence.

Operational frequencies: those authorised for AVI applications—900 to 928 MHz; 2.45 GHz and 5.8 GHz. (Spread spectrum, frequency hopping).

Voltage: supply from vehicle battery or by portable battery (10–16 VDC).

Message reception: all those defined in this invention.

Reception rate: scanning of up to 50 tags per second. Possibility of scanning a limited number of tags simultaneously by using the anti-collision protocol.

Electronic features: adapted AVI technology.

Permissible temperature range: operational between 01C and 501C. Storage—between B201C and 701C.

Resistance to weather conditions: designed for mounting inside a vehicle or for portable use.

What is claimed is:

1. A signaling system for communicating traffic information comprising:

(a) a plurality of radio beacons selected from a group consisting of fixed (TX-F) and portable (TX-M) radio beacons;

(b) a plurality of vehicle-installed mobile transceiver (TX/RX-M) for receipt of traffic information concerning hazardous areas or conditions;

(c) a plurality of user-carried transceiver (TX/RX-P) for receipt of traffic information concerning hazardous areas or conditions;

(d) an operations center for control of said vehicle-installed mobile transceivers and said user-carried transceivers comprising a services network comprising fixed and portable elements;

wherein said signaling system comprises AVI (automatic vehicle identification) technology for identifying and recording time of data received or transmitted by the transceivers;

wherein said AVI technology comprises transmitter elements having (a) operating frequencies authorized for AVI applications selected from a group consisting of 900–928 MHz; 2.45 GHz and 5.8 GHz;

(b) a voltage supply selected from a group consisting of batteries having a life of 10 years and solar cells;

(c) a range selected from a group consisting of up to 10 meters for installation at fixed locations and up to 100 meters for portable installation;

(d) electronic features selected from a group consisting of adapted AVI technology, surface technology (SAW), EPROM, EEPROM, ROM, and RAM memories having a storage capacity of at least 1024 bits;

(e) a permissible temperature range comprising a standard operating temperature of from −40 degree C. to 85 degree C. and storage temperature from −55 degree C. to −125 degree C.; and (f) a resistance to weather conditions.

2. The signalling system according to claim 1 wherein said AVI technology comprises RFID (radio frequency identification) technology using radio frequency transponders and tags.

3. The signalling system according to claim 2 wherein said tags comprise Type I read-only passive tags.

4. The signalling system according to claim 2 wherein said tags comprise Type II active smart tags containing partially-fixed information and partially-recordable information communicated by an external control element.

5. The signalling system according to claim 2 wherein said tags comprise Type III active smart cards with RF transponder tags having more advanced functions and greater storage capacity than Type II smart tags.

6. The signalling system according to claim 1 wherein said AVI technology is installed on vehicles using the system.

7. The signalling system according to claim 1 further comprising tags installed at fixed locations alongside or underneath a road using the system.

8. The signalling system according to claim 1 wherein said AVI technology comprises receiver elements having (a) operating frequencies authorized for AVI applications selected from a group consisting of 900–928 MHz; 2.45 GHz and 5.8 GHz;

(b) a voltage supply of 10–16 VDC supplied by a vehicle battery or portable batteries;

(c) a reception rate for scanning up to 50 tags per second;

(d) adapted AVI technology;

(e) a permissible temperature range comprising an operating temperature from 0° C. to 50° C. and a storage temperature from −20° C. to 70° C.; and (f) a resistance to weather conditions encountered on board a vehicle or when held by a pedestrian.

9. The signalling system according to claim 1 wherein each radio beacon comprises a fixed transmitter having a transmission terminal in a fixed element on a roadside post or a wall or embedded in a road for transmitting continuous short-range radio beaconing signals for pickup by radio beacon receivers and by said transceivers, said transmitter comprising a transmitter unit, an antenna, a self-contained power supply, and a weather condition sensor, said transmitter transmitting alert or assistance messages according to weather conditions to permit modifying speed warnings in accordance with the weather conditions.

10. The signalling system according to claim 1 further comprising a portable transmitter installed on a non-permanent stand for temporary signalling warning and help messages in an occasional or pre-programmed fashion at locations where hazard or assistance exists, said transmitter comprising a transmitter unit, an antenna, a self-contained battery power pack, a fastener, and a support.

11. The signalling system according to claim 1 wherein each vehicle-installed mobile transceiver comprises a reception terminal installed in a motor vehicle for receipt of signals broadcast by the radio beacons and communication of said signals to a vehicle driver by means of audible or visible warnings, said reception terminal comprising a loudspeaker, a repeat-last-message button, warning message filtering buttons, an alphanumeric display, assistance message filtering buttons, programmable function buttons, an antenna connection, a power supply connection, said reception terminal being capable of receiving various alert and assistance messages, filtering different categories of messages, repeating a message last received, storing current data, and being programmable for user and special functions by authorized personnel.

12. The signalling system according to claim 1 wherein each user-carried transceiver comprises a reception terminal carried by a user for receipt of signals broadcast by the radio beacons and communication of said signals to the user by means of audible or visual warnings, said reception terminal comprising a loudspeaker, an antenna, programmable function buttons, an alphanumeric display, warning message filtering buttons, assistance message filtering buttons, and a last-message-repeat button, said reception terminal being capable of receiving various alert and assistance messages, filtering different categories of messages, repeating a message last received, storing current data, and being programmable for user and special functions by authorized personnel.

13. The signalling system according to claim 1 wherein each vehicle-installed mobile transceiver comprises a receiver and a transmitter for receiving signals broadcast by the radio beacons, communication of said signals to a vehicle driver by means of audible or visual warnings, and communication of said signals to third parties, said transceiver comprising a loudspeaker, a repeat-last-message button, warning message filtering buttons, an alphanumeric display, assistance message filtering buttons, programmable function buttons, an S.O.S. button, an antenna connection, a power supply connection, an airbag device connection, and specific warning transmission buttons, said transceiver being capable of receiving various alert and assistance messages, filtering different categories of messages, repeating a message last received, transmitting an S.O.S. signal and specific alert messages, storing current data, and being programmable for user and special functions by authorized personnel.

14. The signalling system according to claim 1 wherein each user-carried transceiver comprises a receiver and a transmitter for receiving signals broadcast by the radio beacons, communication of said signals to the user by means of audible or visual warnings, and communication of said signals to nearby users, said transceiver comprising a loudspeaker, an antenna, programmable function buttons, an alphanumeric display, warning message filtering buttons, assistance message filtering buttons, a repeat-last-message button, and an S.O.S. button, said transceiver being capable of receiving various alert and assistance messages, filtering different categories of messages, repeating a message last received, transmitting an S.O.S. signal and an AEP message, storing current data, and being programmable for user and special functions by authorized personnel.

15. The signalling system according to claim 1 wherein said operation center comprises an operations base for maintenance and control of components of a radio beacon services network, reprogramming, specific signal transmission to selected remote beacon services networks, said operations base comprising antennas for transmission and reception of various warning and assistance messages, remote and local programming of radio beacons, programming of user functions and special functions by authorized personnel, the radio beacon services network comprising fixed elements installed along a road and associated mobile elements, transmitters, maintenance and control components based on fixed or portable devices for use from a mobile unit or maintenance helicopter, the operations base comprising an antenna, an alphanumeric display, function programming buttons and function supervision functions for local and remote programming of radio beacons, user functions and special functions by authorized personnel, supervision of radio beacon status, and transmission and reception of various warning and assistance messages.

* * * * *